US005555860A

United States Patent [19]

Wride

[11] Patent Number: 5,555,860

[45] Date of Patent: Sep. 17, 1996

[54] VALVE CONTROL MECHANISM

[76] Inventor: Donald C. Wride, 35 Helen Terrace, Valley View, South Australia, 5093, Australia

[21] Appl. No.: 140,011

[22] PCT Filed: Apr. 24, 1992

[86] PCT No.: PCT/AU92/00187

§ 371 Date: Jun. 2, 1994

§ 102(e) Date: Jun. 2, 1994

[87] PCT Pub. No.: WO92/19847

PCT Pub. Date: Nov. 12, 1992

[30] Foreign Application Priority Data

Apr. 24, 1991 [AU] Australia ..... PK5759

[51] Int. Cl.[6] ..... F01L 1/04; F01L 1/18; F02D 13/02

[52] U.S. Cl. ..... 123/90.16; 123/90.17

[58] Field of Search ..... 123/90.15, 90.16, 123/90.17, 90.2, 90.27, 90.39, 90.41, 90.44, 90.6

[56] References Cited

U.S. PATENT DOCUMENTS

| | | | |
|---|---|---|---|
| 1,885,796 | 11/1932 | Boulet | 123/90.15 |
| 3,313,280 | 4/1967 | Arutunoff et al. | 123/90.15 |
| 3,888,216 | 6/1975 | Miokovic | 123/90.17 |
| 4,138,973 | 2/1979 | Luria | 123/90.16 |
| 4,459,946 | 7/1984 | Burandt | 123/90.16 |
| 4,535,733 | 8/1985 | Honda | 123/90.17 |
| 4,714,057 | 12/1987 | Wichart | 123/90.15 |
| 5,052,350 | 10/1991 | King | 123/90.16 |
| 5,113,813 | 5/1992 | Rosa | 123/90.16 |
| 5,178,105 | 1/1993 | Norris | 123/90.15 |

FOREIGN PATENT DOCUMENTS

| | | |
|---|---|---|
| B82878/82 | 11/1983 | Australia . |
| 2484016 | 12/1981 | France . |
| 2832526 | 2/1980 | Germany . |
| 3006619A1 | 8/1981 | Germany . |
| 3436629 | 4/1986 | Germany . |
| 3725448 | 2/1989 | Germany . |
| 2180597 | 4/1987 | United Kingdom . |

*Primary Examiner*—Weilun Lo
*Attorney, Agent, or Firm*—Seed and Berry LLP

[57] ABSTRACT

A control mechanism (1) for an engine valve (29) comprising two rotatable cams (8, 10) which engage a lever (2) at two follower regions (23, 34) at different positions, the lever (2) having a zone of application (35) linked to the valve (29) whereby rocking movement of the lever (2) consequent on rotation of the cams (8, 10) causes opening and closing of the valve (29), wherein one of the two cams (8) is in constant engagement with the lever (2) and the other cam (10) is in periodic engagement with the lever (2), a gap (26) being provided between the other cam (10) and its respective follower region (23) when the other cam (10) is not in constant engagement with the lever (2), the width of the gap (26) affecting the duration of opening and closing of the valve (29) and its stroke length. Preferably, the zone of application (35) of the lever (2) is movable longitudinally along the lever (2) to thereby vary the stroke length of the valve (29).

9 Claims, 9 Drawing Sheets

X 10
38
40
8
35
24
23
2
10
8
40
35

38
24
23
2
10
8
38
40
35
24
23
2

X'

FIGURE 9A
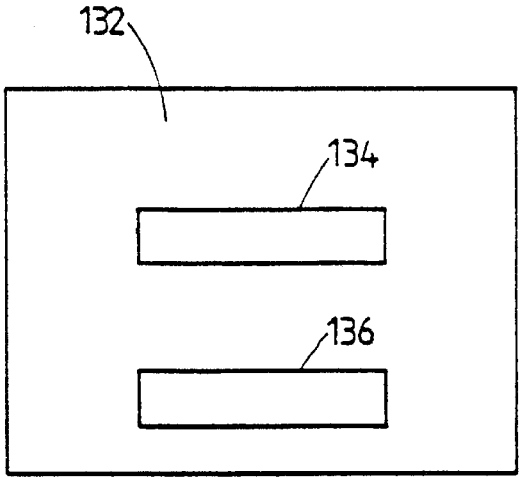
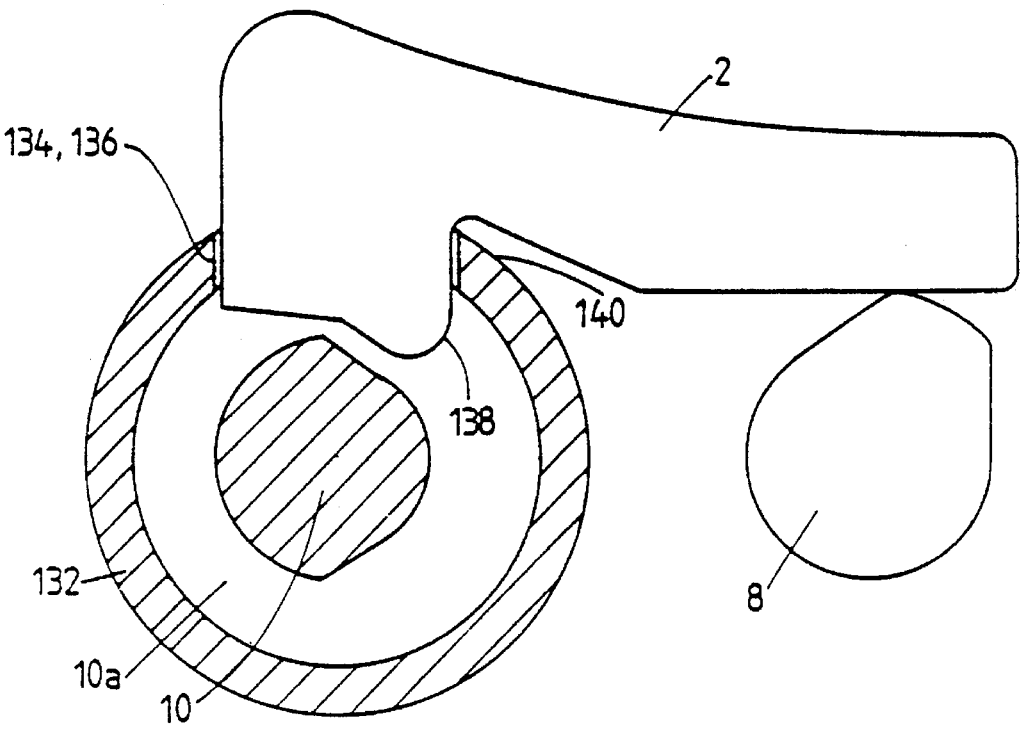
FIGURE 9B

VALVE CONTROL MECHANISM

TECHNICAL FIELD

This invention relates to a valve control mechanism for internal combustion engines.

BACKGROUND OF THE INVENTION

Reciprocating valves in internal combustion engines are typically actuated by a rotating cam operating a push rod, the push rod pressing a rocker arm thereby to depress the valve or alternatively in an overhead camshaft system a rotating camshaft over the engine block engages an intermediate portion of a rocker arm pivoted at one end, the other end depressing the valve. Thus the shape of the cam lobe serves to determine the duration and rate of opening and closing of the valve and the valve stroke length.

A number of systems have been previously proposed, for instance in Australian Patent Application No. 82878/82, to provide a second rotating cam operating on a rocker arm which second cam can be actuated to provide further control over operation of an engine valve. Such systems, however, are quite limited in their application as only a small number of control parameters can be altered to affect operation of the valve. This limitation severely restricts the ability to make adjustments to the system when it is desired to optimise engine performance under different operating conditions.

SUMMARY OF THE INVENTION

According to the present invention there is provided a control mechanism for an engine valve comprising two rotatable cams which engage a lever at two follower regions at different positions, the lever having a zone of application linked to the valve whereby rocking movement of the lever consequent on rotation of the cams causes opening and closing of the valve, wherein one of the two cams is in constant engagement with the lever and the other cam is in periodic engagement with the lever, a gap being provided between the other cam and its respective follower region when the other cam is not in constant engagement with the lever, the width of the gap affecting the duration of opening and closing of the valve and its stroke length.

Advantageously, the zone of application of the lever is movable longitudinally along the lever to thereby vary the stroke length of the valve.

Advantageously, the lever is movable transversely with respect to the axis of the cams and is profiled so that the gap width is varied by said transverse movement of the lever to thereby vary the timing of the valve.

Each of the cams may be of a different shape and/or size and thereby allow a very wide choice of the duration of valve opening and closing and of the valve stroke length, commonly referred to as lift. As with normal single camshaft driven valves, the shape and size of the first cam determines the position of the valve, its stroke length and its duration of opening or closing. However by the combination of the two cams operating on a pivoted lever, the pivoted lever serving to actuate the valve, there is provided the ability to alter the valve control mechanism to optimise engine performance under specific operating conditions. Further, the gap provided between the lever and the other cam gives the ability to time the cams so that the valve will open and close over a small portion of the piston stroke, this being achieved by timing the cams so that as one cam is about to lift the valve the other cam is nearing the end of its lift thereby giving a brief opening and shutting of the valve.

Further, the gap provided between the lever and the other cam eliminates the requirement to provide a heat expansion gap as the cam and the lever only engage during a part of each cycle. Also, as the contact of the other cam and its respective region is periodic, the amount of wear on these respective surfaces is significantly reduced.

The lever can be of any appropriate shape to allow the cams to engage the respective follower regions. A further variation may, for example, have a lever in which the or each of the follower regions is tapered such that the surface which contacts the or each cam is inclined obliquely to it. Alternative constructions of the lever, in addition to the various configurations of cam lobes which the dual camshaft per valve arrangement allows, gives considerable flexibility when it is desired to make alterations to the valve control mechanism in order to optimise engine performance. Further, the lift of the valve and the valve timing may be varied to suit specific operating conditions while the engine is running.

Conveniently each of the cams is mounted such that its axis is parallel to the crankshaft of the engine. However, depending on the orientation of the lever, a transverse camshaft system may be invisaged. The present invention is not limited to reciprocating valves and may find application in other valve systems, for example rotary valves.

BRIEF DESCRIPTION OF THE DRAWINGS

Embodiments of the invention will now be described by way of example only with reference to the accompanying drawings in which:

FIGS. 9A and 9B show a preferred means of mounting a lever on a camshaft.

DETAILED DESCRIPTION OF THE INVENTION

Figure 1:
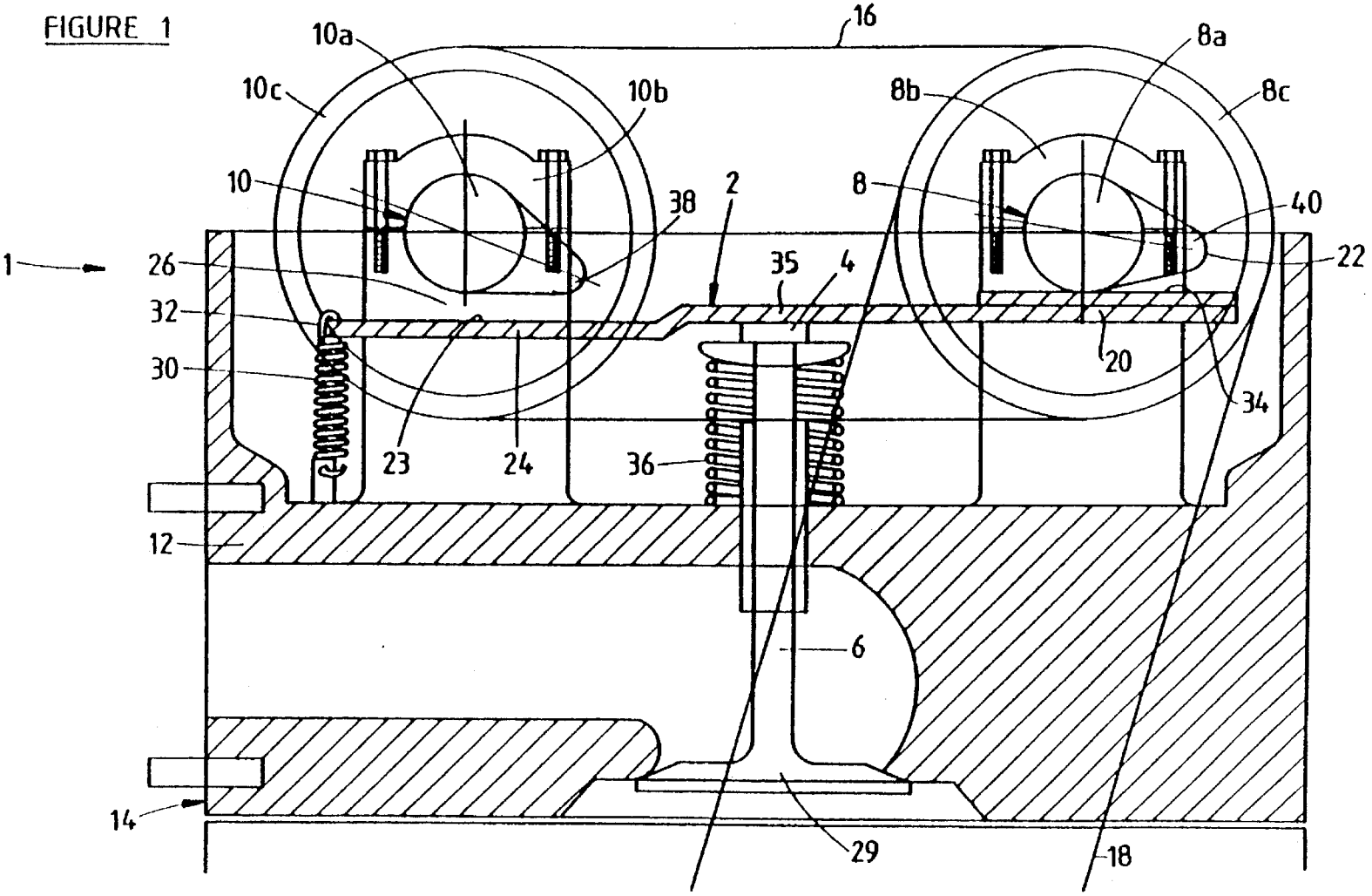
FIG. 1 shows a schematic sectional view of a first embodiment.

For convenience, throughout the description of the drawings, the same reference numeral will be used for the same or similar parts or components in the various embodiments.

Referring to FIG. 1, the valve control mechanism, generally indicated by the numeral 1, comprises a lever 2 which pivots on an end portion 4 of a reciprocating valve stem 6, the lever 2 being adapted to engage cams 8, 10 of a first camshaft 8*a* and a second camshaft 10*a* both of which are rotatable within bushings (not shown) mounted within respective journals 8*b*, 10*b* mounted to a cylinder head 12 of an internal combustion engine 14. The camshafts 8*a*, 10*a* have their longitudinal axes parallel to each other and rotate at the same speed by being directly coupled to pulleys 8*c*, 10*c* which are mounted concentrically onto the respective camshafts 8*a*, 10*a*. The direct coupling may, for example, be a linked chain 16. The camshafts 8*a*, 10*a* are driven by way of one of the camshaft pulleys 8*c*, 10*c* being directly coupled, for example, by a chain 18 to a crankshaft pulley (not shown). When used in a four stroke engine the camshafts 8*a* and 10*a* typically rotate at half the rotational speed of the crankshaft pulley.

A first end portion 20 of the lever 2 is held in constant engagement with the first cam 8 surface 22 and an upper surface 23 of an intermediate portion 24 of the lever 2 is maintained in periodic engagement with the second cam 10. This periodic engagement is effected by providing a gap 26 between the second cam 10 and the upper surface 23 of the lever 2. The width of the gap 26 may, of course, be altered by substituting another cam 10 or by altering the shape or profile of the intermediate portion 24 of the lever 2. A spring 30 connected between a second end portion 32 of the lever 2 and the cylinder head 12 acts to urge the upper surface 34 of the first end portion 20 of the lever 2 into continuous contact with the first cam 8 to thereby reduce the likelihood of hammering due to inertia.

In use, the rotation of the cams 8, 10 causes the valve 29 to open and close by way of the cams 8, 10 engaging the respective portions 20, 24 of the lever 2 causing a zone of application 35 on the lever to depress the valve 29 against the restoring force of the valve spring 36.

Figures 2A, 2B, 2C:
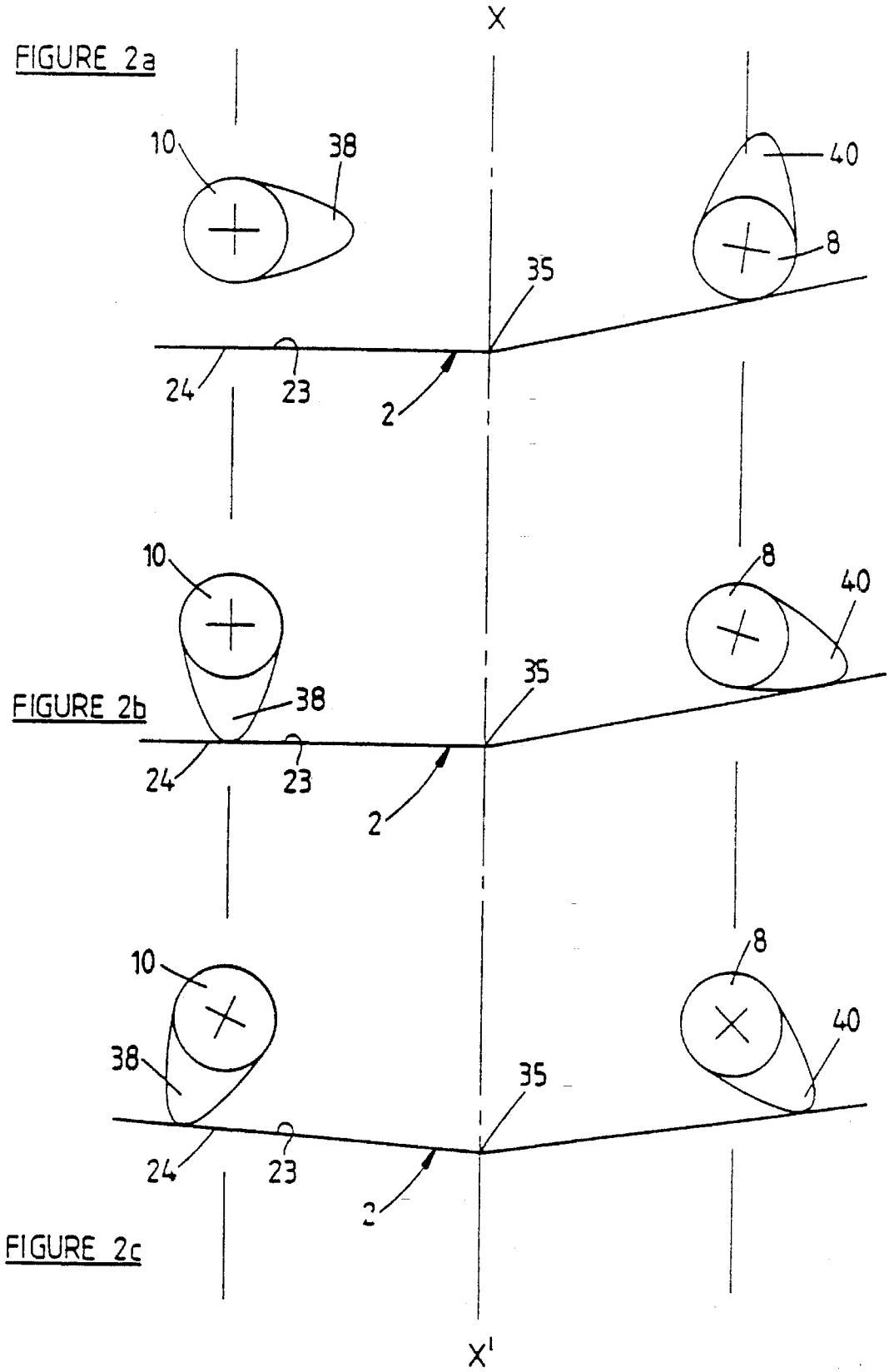
FIGS. 2A, 2B and 2C show the embodiment of FIG. 1 during three points of a working cycle.

FIGS. 2A, 2B and 2C depict three points in the cycle of a valve control mechanism 1 of the present invention in which the respective lifts of the first cam 8 and the second cam 10 are the same and the width of the gap 26 is also the same as the lift of the two cams 8, 10, the valve 29 reciprocating along an axis X—X'. However, the width of the gap 26 may be increased or decreased to suit particular operating conditions. As shown in FIGS. 2A and 2B, the gap 26 provided between the second cam 10 and the upper surface 23 of the intermediate portion 24 of the lever 2 results in the valve 29 being able to open only when the lobe 38 of the second cam 10 comes into contact with the upper surface 23 of the intermediate portion 24 of the lever 2 against the restoring force of the valve spring 36. As shown in FIG. 2C, further clockwise rotation of the lobe 40 of the first cam 8 causes the valve 29 to open while the concurrent rotation of the lobe 38 of the second cam 10 causes the valve 29 to begin to close so that a very smooth opening and closing operation of the valve 29 is achieved over a small portion of the piston stroke. The combined action of the lobes 38, 40 on the cams 8, 10 and the respective shapes of the cams 8, 10 and of the lever 2 allow considerable flexibility in altering the duration of the opening and closing of the valve 29, the valve timing and the valve stroke length.

Figure 3:
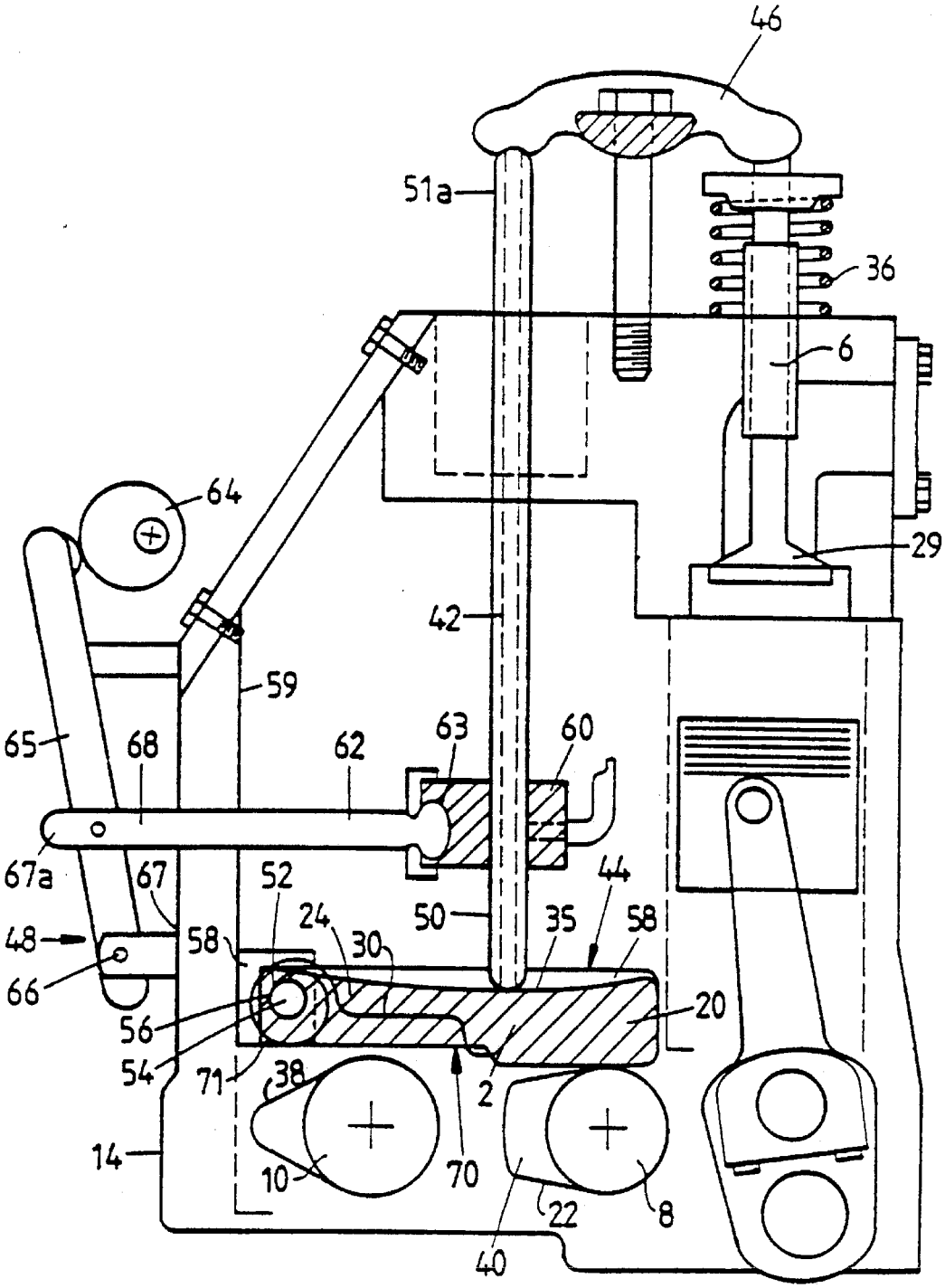
FIG. 3 shows a schematic sectional view of a second embodiment.

FIG. 3 shows a second embodiment of the valve control mechanism 1 of the present invention in which a pushrod 42 engages the zone of application 35 on a top face 44 of the lever 2 to open and close the valve 29 via a pivoted valve rocker member 46. This embodiment also includes a valve stroke length adjustment mechanism 48 by which a bottom portion 50 of the pushrod 42 can be moved transversely along the lever 2, the bottom portion 50 having a roller end fitted to it (not shown), to facilitate movement of the zone of application 35 along the length of the lever 2 to enable the lift of the valve 29 to be varied. The lever 2 is adapted to pivot at a second end portion 52 of the lever on a pin 54 which is inserted into an elongate slot 56 in a boss 58 cast integrally with the engine crankcase inner wall 59. The first end portion of the lever 20 is held in continuous engagement with the surface 22 of the first cam 8 by way of the resilient bias of the valve spring 36 and by the intermediate portion 24 of the lever 2 being urged upwardly by the spring 30. This configuration also ensures that the gap 26 is maintained when the second cam 10 is not in engagement with the lever 2.

The bottom end 51 of the pushrod 42 is movable along the length of the lever 2 within a radiused groove 58 which is milled in the top face 44 of the lever 2, the radius of curvature of the groove 58 being the same as the length of the pushrod 42. In use, the bottom portion 50 of the pushrod 42 is moved by the valve stroke length adjustment mechanism 48 which comprises a lubricated bush 60 in which the pushrod 42 can reciprocate and a transverse rod 62 which is adapted to engage the bush 60 by means of a ball joint 63, the rod 62 being movable inwardly and outwardly of the engine 14 by way of an eccentric cam 64 which engages a lever 65 which is pivotally connected at a bottom end portion 66 to an outer wall 67 of the engine 14 and also pivotally connected to one end portion 68 of the rod 62 whereby rotation of the eccentric cam 64 results in transverse movement of the rod 62 and the bush 60, thereby enabling the zone of application 35 of the lever 2 to be moved along the length of the lever 2. When the end 51 of the push rod 42 is positioned towards the center of the second cam shaft 10 the valve lift is a minimum however when the end 51 is towards the center of the first cam 8 the lift of the valve is at its maximum. The stroke length of the valve 29 can therefore be altered to suit specific operating conditions, even while the engine is running.

It should also be noted that the lever 2 is adapted by way of a recess 70 on the underside 71 of the lever 2 to ensure that when the second cam 10 has reached its position of maximum lift, the lever 2 is substantially horizontal to ensure that the center of curvature of the arc scribed by the bottom end 51 of the pushrod 42 is generally co-incident with the upper end 51*a* of the pushrod 42 so that the end 51 is unimpeded in its movement along the lever 2 when the lobes 38, 40 are not in contact with it.

Figure 4:
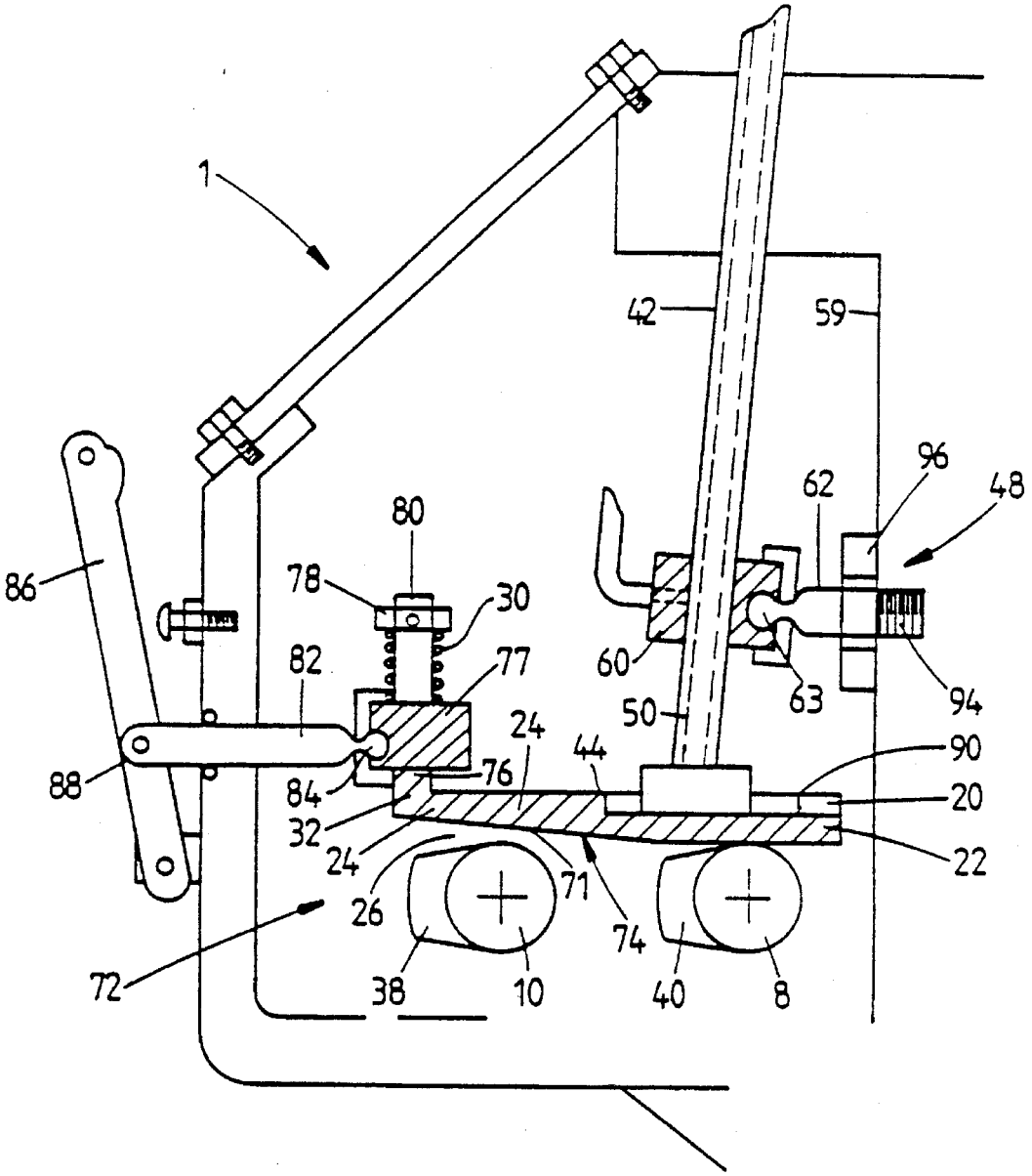
FIG. 4 shows a schematic sectional view of a third embodiment.

In a third embodiment, as depicted in FIG. 4, the valve control mechanism 1 includes a valve timing arrangement 72 comprising a lever 2 having a taper 74 on its underside 71, the taper 74 being narrower at the second end portion 32 of the lever 2 such that when the lever 2 is moved to the left with respect to the cams 8, 10, that is reducing the gap 26, the valve 29 will open sooner and close later. Conversely, if the lever 2 is moved to the right, the valve 29 will open later and close sooner. The lever 2 has also an integral upright portion 76 which reciprocates within a lubricated bush 77, the upright portion 76 being urged upwardly by a spring 30 held captive between the bush 77 and a nut 78 which is threaded onto the upper portion 80 of the upright 76 to thereby provide the gap 26 when the lobe 38 of the cam 10 is not in contact with the underside 71 of the lever 2. The lever 2 is moved transversely by way of a rod 82 connected to a ball joint 84, the rod 82 being pivoted to a pivoted lever 86 at an intermediate portion 88 so that clockwise rotation of the lever causes the lever 2 to move to the right.

A valve stroke adjustment mechanism 48 is mounted on the crankcase inner wall 59, its operation being independent of the relative position of the lever 2, and comprises a lubricated bush 60 in which the pushrod 42 can reciprocate and a rod 62 which is adapted to engage the bush 60 by way of the ball joint 63, the rod 62 having a threaded portion 94 whereby rotation of the rod within a captive nut 96 fixed to the crankcase inner wall 59 results in movement of the bottom end 51 of the pushrod 42 along the lever 2. The lever 2 has a longitudinal U-shaped channel 90 milled in the upper surface 44 of its first end portion 20 and a sliding pad 92 mounted to the bottom end portion 50 of the pushrod 42 is slidable longitudinally along the channel 90 whereby the stroke length of the valve can be varied.

The features of the second and third embodiments depicted in FIGS. 3 and 4 can be combined to provide adjustment to both the valve timing and the valve stroke length. This is shown as a fourth embodiment in FIG. 5 in which a tapered timing lever 98 is pivotally connected at its narrower end portion 99 to a plate 100 which is, in turn, pivotally connected to a rod 102. The rod 102 is movable inwardly and outwardly of the engine 14, by rotation of a lever 104, thereby moving the timing lever 98 transversely with respect to the axis of the cams 8, 10 to alter the width of the gap 26 between the second cam 10 and the timing lever 98 to vary the valve timing. The narrow end portion 99 of the timing lever 98 being urged upwards by a spring 30 fitted to the boss 58 to maintain the gap 26 when the lobe 38 is not contacting the timing lever 98. Valve stroke adjustment is provided by way of a valve stroke adjustment mechanism 48 as previously described for the second embodiment.

Figure 5:
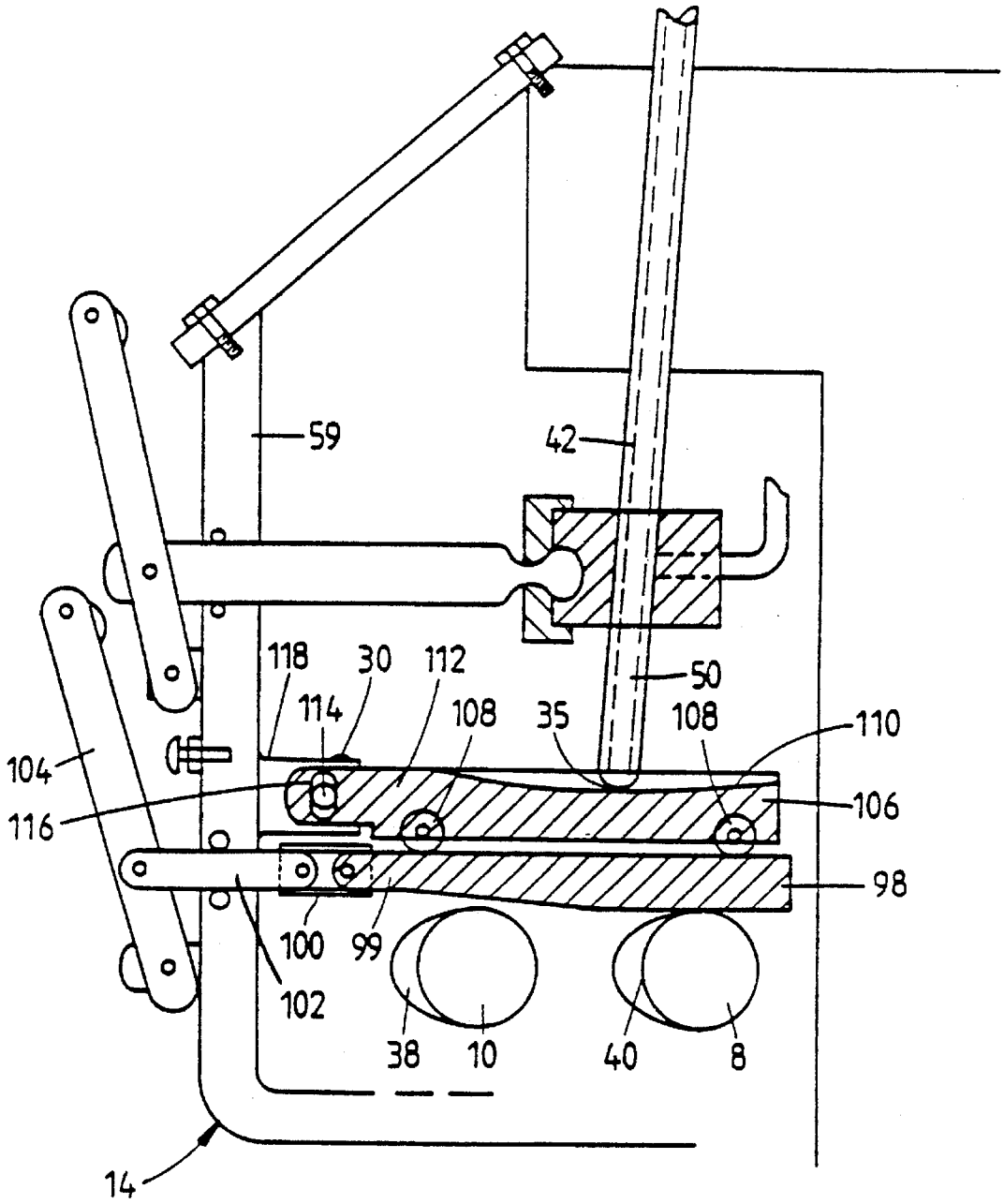
FIG. 5 shows a schematic sectional view of a fourth embodiment.

FIG. 5 shows the cams 8, 10 positioned in relation to the tapered timing lever 98 so that the second cam 10 is not in contact with it, showing the gap 26, and a pushrod lift lever 106 is adapted, by way of rollers 108, to move along the length of the top face 110 of the timing lever 98, the pushrod lever 106 being adapted to pivot at one end portion 112 by way of a pin 114 inserted into an elongate slot 116 formed in a boss 118 integral with the crankcase inner wall 59. Further, the bottom end portion 50 of the pushrod 42 has a roller end (not shown) enabling the bottom end 51 of the pushrod 42 to be moved along the length of the pushrod lift lever 106 by way of the valve stroke adjustment mechanism 48, as previously described for the second embodiment, so that the zone of application 35 can be moved along the length of the lever 106 to alter the lift of the valve 29.

Figure 6:
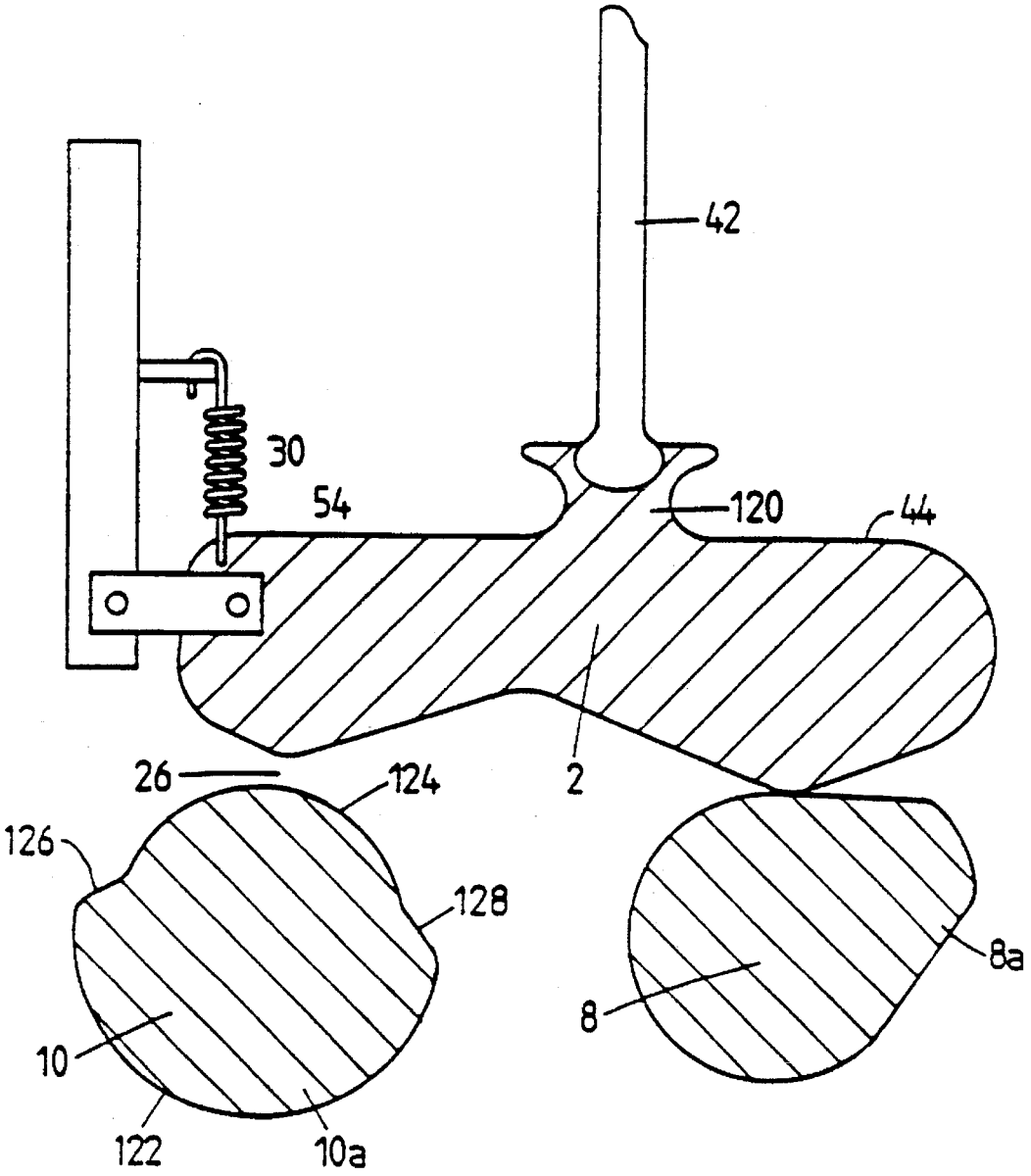
FIG. 6 shows a schematic sectional view of a fifth embodiment.

FIG. 6 shows another embodiment in which the lever 2 includes a socket 120 on its top face 44 into which a pushrod 42, or valve stem, is inserted. The second cam 10 has a profile comprising opposed arcs 122, 124 and two spaced ramped sections 126, 128 joining the arcs 122 and 124, and the gap 26 is provided by virtue of arc 124 having a smaller radius of curvature than that of arc 122. The ramp 128 on the second cam 10 has a small angle such that on clockwise rotation of the second cam 10 the closing of the valve is prolonged, whereas the ramp 126 which serves to open the valve has a more acute angle so that the valve is opened quickly. If the angle of the ramped sections 126, 128 is reduced, the valve 29 will remain open for a longer duration and provide a smoother opening and closing of the valve.

Figure 7:
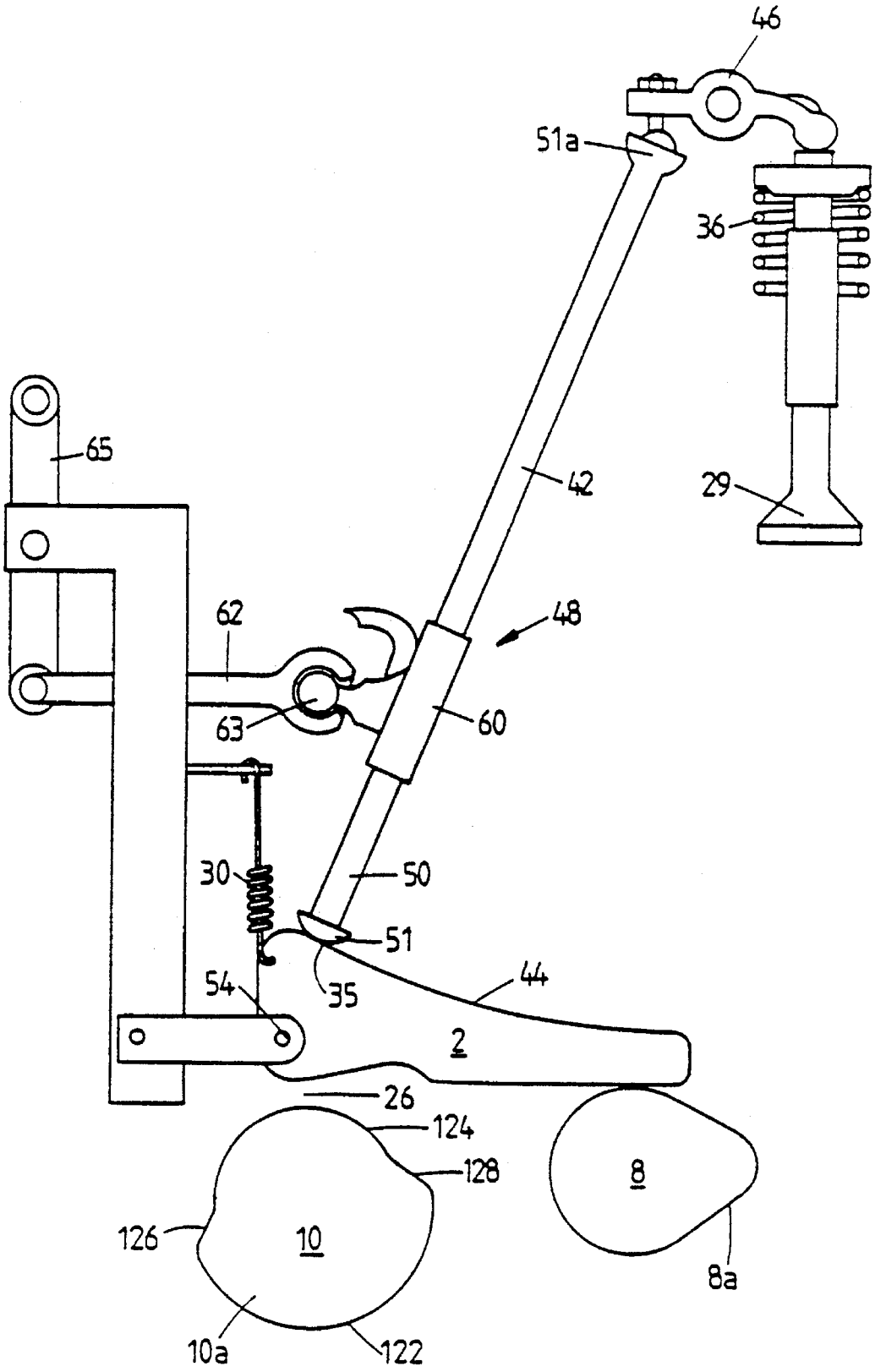
FIG. 7 shows a schematic sectional view of a sixth embodiment.

FIG. 7 shows an embodiment similar to that shown in FIG. 6 however the lever 2 has a curved top face 44 along which the bottom end 51 of the pushrod 42 can move under the action of a valve stroke length adjustment mechanism 48 to vary the lift of the valve from minimal to full lift. In this embodiment the radius of curvature of the top face 44 of the lever 2 is the same as the length of the push rod 42 and its centre generally coincides with the upper end 51*a* of the pushrod 42 so that the end 51 is unimpeded in its movement along the lever 2 when the lobe 38 is not in contact with it.

Figure 8:
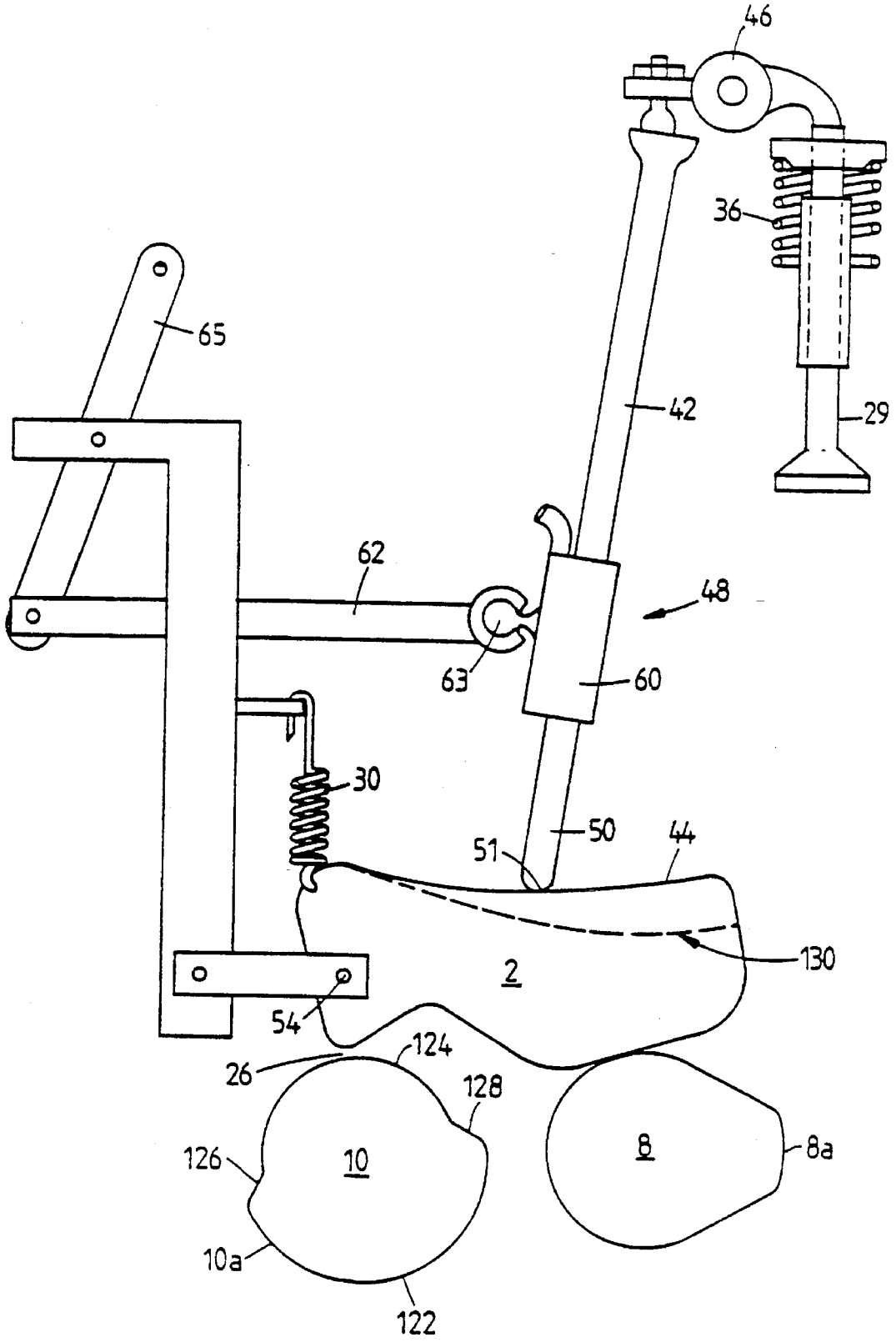
FIG. 8 shows a schematic sectional view of a seventh embodiment.

FIG. 8 shows a valve arrangement similar to that of FIG. 7 except that the center of the radius of curvature of the top face 44 of the lever 2 does not generally coincide with the upper end 51*a* of the push rod 42, it being displaced to the left of the Figure, and the arc which would otherwise be scribed by the end 51 of the push rod 42 is shown as a dashed line on lever 2 and is numbered 130. As shown, the top face 44 of the lever 2 is inclined upwardly of the normal arc 130 such that a greater variation in valve lift can be obtained for an equivalent amount of movement of the end 51 along the length of the lever 2 as compared to that of the embodiment of FIG. 7.

FIGS. 9A and 9B show means for mounting the lever 2 on the second camshaft 10*a*, rather than mounting it for pivotal movement on the engine crankcase inner wall 59 as depicted in FIGS. 3, 5, 6, 7 and 8. The means comprises a length of tubing 132 having two elongate slots 134, 136 milled in its curved surface, the longitudinal direction of the slots 134, 136 being normal to the axis of the camshaft 10*a*. The tubing 132 is fitted concentrically over the second camshaft 10*a* and the second end portion of the lever is configured such that its end 138 (shown in FIG. 9B) can pass through the slots 134, 136 to engage the cam 10. The lever 2 is supported by the outer surface 140 of the tubing 132 and the elongate slots 134, 136 allow the lever 2 to move up and down relative to the camshaft 10*a* while preventing it from moving in the direction of the camshaft axis. It is also envisaged that the slots 134, 136 could be formed in a boss which is integral with the engine crankcase inner wall 59.

The embodiments have been described by way of example only and modifications are possible within the scope of the invention.

I claim:

1. A control mechanism for an engine valve, comprising two rotatable cams which engage a lever at two follower regions at different position, the lever having a zone of application linked to the valve whereby rocking movement of the lever consequent on rotation of the cams causes opening and closing of the valve, wherein one of the two cams is in constant engagement with the lever and the other cam is in periodic engagement with the lever, a gap being provided between the other cam and its respective follower region when the other cam is not in periodic engagement with the lever, the width of the gap affecting the duration of opening and closing of the valve and its stroke length, said zone of application being linked to the valve by means comprising a pushrod intermediate the lever and the valve such that one end of the pushrod engages the lever at the zone of application of the lever, the arrangement being such that said one end of the pushrod is movable along the lever to thereby vary the valve stroke length.

2. A control mechanism for an engine valve as claimed in claim 1, further comprising means for moving said one end of the pushrod along the lever and including a support in which the pushrod can reciprocate along its longitudinal axis and a member engaging the support, the arrangement being such that the support is movable by the member in a direction substantially normal to the axis of the cams to thereby move said one end of the pushrod along the lever.

3. A control mechanism for an engine valve as claimed in claim 1, wherein the zone of application lies on a curved surface which faces the cams whereby movement of said one end of the pushrod along the curved surface results in a non-linear change of the duration of opening and closing of the valve.

4. A control mechanism for an engine valve as claimed in claim 3, wherein the radius of curvature of said curved surfaces has a center which lies substantially on the longitudinal axis of the pushrod and has a radius substantially the same as the length of the pushrod.

5. A control mechanism for an engine valve as claimed in claim 3, wherein the radius of curvature of said curved surface has its center spaced from the longitudinal axis of the pushrod.

6. A control mechanism for an engine valve as claimed in claim 1, wherein the zone of application lies on a groove formed in the lever.

7. A control mechanism for an engine valve as claimed in claim 1, wherein a length of tubing is mounted concentrically on a camshaft associated with said other cam, the tubing having elongate slots formed in its curved surface and through which the lever can pass to engage said other cam, the arrangement being such that the lever is restricted by the slots to movement in a plane substantially normal to the axis of the cams.

8. A control mechanism for an engine valve comprising first and second rotatable cams which engage a lever at two follower regions at different positions, the lever having a zone of application linked to the valve by a valve linkage whereby rocking movement of the lever consequent on rotation of the cams causes opening and closing of the valve, wherein the valve has an operational cycle which includes an active period during which both cams engage simultaneously with said lever to actuate said valve, and an inactive period during which said first cam is in continuous engagement with said lever and said second cam is spaced by a gap from its respective follower region on said lever, the width of the gap affecting the duration of opening and closing of the valve and its stroke length, and means for biasing said lever into contact with said first cam and said valve linkage at least during the inactive period, wherein the valve linkage comprises a pushrod intermediate said lever and said valve such that one end of said pushrod engages said lever at said zone of application of said lever, means mounting the pushrod such that said one end of said pushrod is movable along said lever to thereby vary the valve stroke length, and means for moving said one end of said pushrod along said lever.

9. A control mechanism for an engine valve as claimed in claim 8 wherein the means for moving said one of said pushrod along the lever comprises a support in which said pushrod can reciprocate and a member engaging the support, the support being movable by the member in a direction substantially normal to the axis of the cams to thereby move said one end of said pushrod along said lever.

* * * * *